US008638899B2

(12) United States Patent
Smith et al.

(10) Patent No.: US 8,638,899 B2
(45) Date of Patent: Jan. 28, 2014

(54) METHODS AND APPARATUSES FOR PRODUCING ISOTOPES IN NUCLEAR FUEL ASSEMBLY WATER RODS

(75) Inventors: David Grey Smith, Leland, NC (US); William Earl Russell, II, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 638 days.

(21) Appl. No.: 12/458,531

(22) Filed: Jul. 15, 2009

(65) Prior Publication Data

US 2011/0013739 A1 Jan. 20, 2011

(51) Int. Cl.
*G21C 23/00* (2006.01)

(52) U.S. Cl.
USPC ..... 376/342; 376/327; 376/453

(58) Field of Classification Search
USPC ..... 376/340–342, 100–200
See application file for complete search history.

(56) References Cited

U.S. PATENT DOCUMENTS

| | | | |
|---|---|---|---|
| 3,594,275 | A | 7/1971 | Ransohoff et al. |
| 3,940,318 | A | 2/1976 | Arino et al. |
| 3,998,691 | A | 12/1976 | Shikata et al. |
| 4,196,047 | A | 4/1980 | Mitchem et al. |
| 4,284,472 | A | 8/1981 | Pomares et al. |
| 4,462,956 | A | 7/1984 | Boiron et al. |
| 4,475,948 | A | 10/1984 | Cawley et al. |
| 4,493,813 | A | 1/1985 | Loriot et al. |
| 4,532,102 | A | 7/1985 | Cawley |
| 4,597,936 | A | 7/1986 | Kaae |
| 4,617,985 | A | 10/1986 | Triggs et al. |
| 4,663,111 | A | 5/1987 | Kim et al. |
| 4,708,846 | A | 11/1987 | Patterson et al. |
| 4,729,903 | A | 3/1988 | McGovern et al. |
| 4,782,231 | A | 11/1988 | Svoboda et al. |
| 4,859,431 | A | 8/1989 | Ehrhardt |
| 5,053,186 | A | 10/1991 | Vanderheyden et al. |
| 5,145,636 | A | 9/1992 | Vanderhevden et al. |
| 5,149,495 | A | 9/1992 | Elkins |
| 5,355,394 | A | 10/1994 | Van Geel et al. |
| 5,400,375 | A | 3/1995 | Suzuki et al. |

(Continued)

FOREIGN PATENT DOCUMENTS

JP 61173190 A 8/1986

OTHER PUBLICATIONS

EP Search Report and Opinion issued Sep. 8, 2011 issued in connection with corresponding EP Application No. 10168990.9.

*Primary Examiner* — Timothy A Brainard
(74) *Attorney, Agent, or Firm* — Harness, Dickey & Pierce, P.L.C.

(57) ABSTRACT

Example embodiments are directed to methods and apparatuses for generating desired isotopes within water rods of nuclear fuel assemblies. Example methods may include selecting a desired irradiation target based on the target's properties, loading the target into a target rod based on irradiation target and fuel assembly properties, exposing the target rod to neutron flux, and/or harvesting isotopes produced from the irradiation target from the target rod. Example embodiment target rods may house one or more irradiation targets of varying types and phases. Example embodiment securing devices include a ledge collar and/or bushing that support target rods within a water rod and permit moderator/coolant flow through the water rod. Other example embodiment securing devices include one or more washers with one or more apertures drilled therein to hold one or more example embodiment target rods in a water rod while permitting coolant/moderator to flow through the water rod.

20 Claims, 7 Drawing Sheets

(56) References Cited

U.S. PATENT DOCUMENTS

| | | | | | |
|---|---|---|---|---|---|
| 5,416,813 | A | * | 5/1995 | Hiraiwa et al. | 376/419 |
| 5,513,226 | A | | 4/1996 | Baxter et al. | |
| 5,553,108 | A | | 9/1996 | Johansson | |
| 5,596,611 | A | | 1/1997 | Ball | |
| 5,615,238 | A | | 3/1997 | Wiencek et al. | |
| 5,633,900 | A | | 5/1997 | Hassal | |
| 5,646,973 | A | * | 7/1997 | Proebstle et al. | 376/434 |
| 5,682,409 | A | | 10/1997 | Caine | |
| 5,758,254 | A | | 5/1998 | Kawamura et al. | |
| 5,790,622 | A | * | 8/1998 | Steinberg et al. | 376/450 |
| 5,867,546 | A | | 2/1999 | Hassal | |
| 5,871,708 | A | | 2/1999 | Park et al. | |
| 5,910,971 | A | | 6/1999 | Ponomarev-Stepnoy et al. | |
| 6,056,929 | A | | 5/2000 | Hassal | |
| 6,160,862 | A | | 12/2000 | Wiencek et al. | |
| 6,192,095 | B1 | | 2/2001 | Sekine et al. | |
| 6,233,299 | B1 | | 5/2001 | Wakabayashi | |
| 6,456,680 | B1 | | 9/2002 | Abalin et al. | |
| 6,539,073 | B1 | | 3/2003 | Smith et al. | |
| 6,574,295 | B2 | | 6/2003 | Nakayama et al. | |
| 6,678,344 | B2 | | 1/2004 | O'Leary et al. | |
| 6,751,280 | B2 | | 6/2004 | Mirzadeh et al. | |
| 6,804,319 | B1 | | 10/2004 | Mirzadeh et al. | |
| 6,895,064 | B2 | | 5/2005 | Ritter | |
| 6,896,716 | B1 | | 5/2005 | Jones, Jr. | |
| 7,157,061 | B2 | | 1/2007 | Meikrantz et al. | |
| 7,235,216 | B2 | | 6/2007 | Kiselev et al. | |
| 2002/0034275 | A1 | | 3/2002 | Abalin et al. | |
| 2003/0012325 | A1 | | 1/2003 | Kernert et al. | |
| 2003/0016775 | A1 | | 1/2003 | Jamriska, Sr. et al. | |
| 2003/0103896 | A1 | | 6/2003 | Smith | |
| 2003/0179844 | A1 | | 9/2003 | Filippone | |
| 2004/0091421 | A1 | | 5/2004 | Aston et al. | |
| 2004/0105520 | A1 | | 6/2004 | Carter | |
| 2004/0196942 | A1 | | 10/2004 | Mirzadeh et al. | |
| 2004/0196943 | A1 | | 10/2004 | Di Caprio | |
| 2005/0105666 | A1 | | 5/2005 | Mirzadeh et al. | |
| 2005/0118098 | A1 | | 6/2005 | Vincent et al. | |
| 2006/0062342 | A1 | | 3/2006 | Gonzalez Lepera et al. | |
| 2006/0126774 | A1 | | 6/2006 | Kim et al. | |
| 2007/0133731 | A1 | * | 6/2007 | Fawcett et al. | 376/202 |
| 2007/0133734 | A1 | | 6/2007 | Fawcett et al. | |
| 2007/0297554 | A1 | | 12/2007 | Lavie et al. | |
| 2008/0031811 | A1 | | 2/2008 | Ryu et al. | |
| 2008/0076957 | A1 | | 3/2008 | Adelman | |
| 2009/0122946 | A1 | | 5/2009 | Fawcett et al. | |

* cited by examiner

METHODS AND APPARATUSES FOR PRODUCING ISOTOPES IN NUCLEAR FUEL ASSEMBLY WATER RODS

BACKGROUND

1. Field

Example embodiments generally relate to fuel structures used in nuclear power plants and methods for using fuel structures.

2. Description of Related Art

Generally, nuclear power plants include a reactor core having fissile fuel arranged therein to produce power by nuclear fission. A common design in U.S. nuclear power plants is to arrange fuel in a plurality of cladded fuel rods bound together as a fuel assembly, or fuel assembly, placed within the reactor core. These fuel assemblies may include one or more interior channels, or water rods, that permit fluid coolant and/or moderator to pass through the assembly and provide interior heat transfer/neutron moderation without significant boiling.

As shown in FIG. 1, a conventional fuel assembly 10 of a nuclear reactor, such as a BWR, may include an outer channel 12 surrounding an upper tie plate 14 and a lower tie plate 16. A plurality of full length fuel rods 18 and/or part length fuel rods 19 may be arranged in a matrix within the fuel assembly 10 and pass through a plurality of spacers (also known as spacer grids) 20 axially spaced one from the other and maintaining the rods 18, 19 in the given matrix thereof. The fuel rods 18 and 19 are generally continuous from their base to terminal, which, in the case of the full length fuel rod 18, is from the lower tie plate 16 to the upper tie plate 14.

One or more water rods 22 may be present in an interior or central position of assembly 10. Water rods 22 may extend the full-length of assembly 10 or terminate at a desired level to provide fluid coolant/moderator throughout assembly 10. Water rods 22 may be continuous, preventing fluid from flowing outside the rods 22, or perforated, segmented, or otherwise broken to permit fluid coolant moderator to flow between rods 22 and the remainder of assembly 10.

FIGS. 2A-2D are axial cross-section illustrations of conventional 10×10 fuel assemblies like those shown in FIG. 1, showing various water rod configurations in conventional assemblies. As shown in FIGS. 2A-2D, water rods 22 may be a variety of lengths (such as full-length or part-length), sizes (for example, rod-sized cross-section or larger), and shapes (including circular, rectangular, peanut-shaped, etc.). Similarly, any number of distinct rods 22 may be present in conventional assemblies 10, depending on the desired neutronic characteristics of assemblies having the water rods 22. Water rods 22 may be symmetric about an assembly center, as shown in FIGS. 2A and 2D, or offset as shown in FIGS. 2B and 2C.

SUMMARY

Example embodiments are directed to methods and apparatuses for generating desired isotopes within water rods of nuclear fuel assemblies. Example methods may include selecting a desired irradiation target based on the target's properties, loading the target into a target rod based on irradiation target and fuel assembly properties, exposing the target rod to neutron flux, and/or harvesting isotopes produced from the irradiation target from the target rod.

Example embodiment target rods may house one or more irradiation targets of varying types and phases. Example embodiment target rods may further secure and contain irradiation targets within a water rod of a nuclear fuel assembly.

Example embodiment target rods may be affixed to or secured with example embodiment securing devices to water rods to maintain their position during operation of a nuclear reactor containing the fuel assembly.

Example embodiment securing devices include a ledge collar and/or bushing that support target rods within a water rod and permit moderator/coolant flow through the water rod. Other example embodiment securing devices include one or more washers with one or more apertures drilled therein to hold one or more example embodiment target rods in a water rod while permitting coolant/moderator to flow through the water rod. Example embodiment washers may be joined to water rods to secure their position. Example embodiments and methods may be used together or with other methods in order to produce desired isotopes.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1:
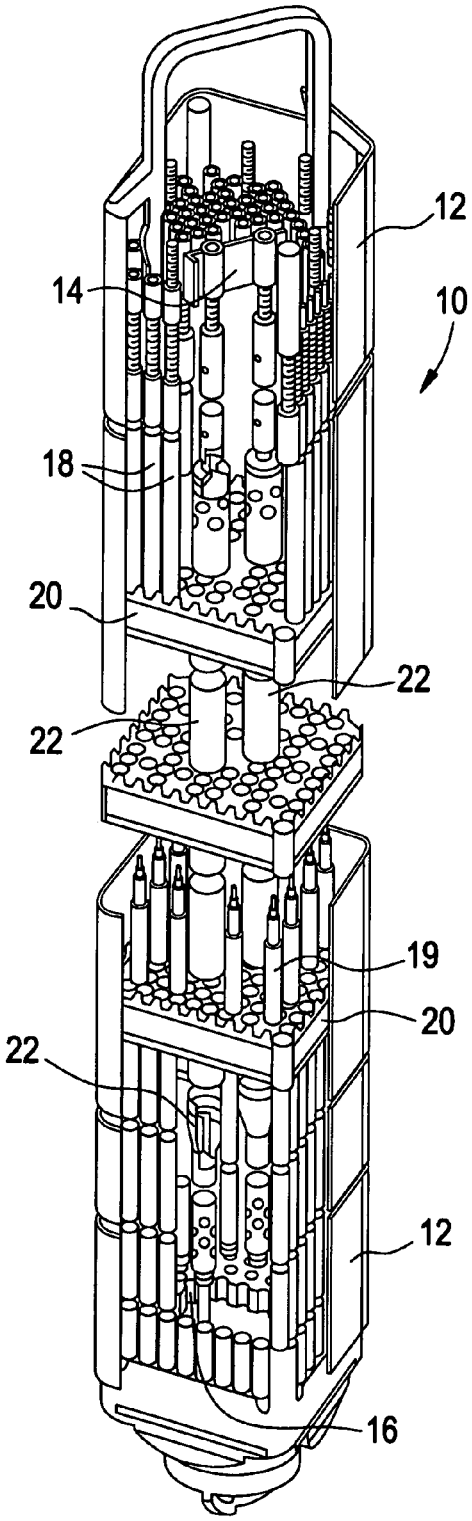
FIG. 1 RELATED ART
FIG. 1 is an illustration of a related art fuel assembly having two continuous, full-length water rods in the assembly.
Figure 2A:
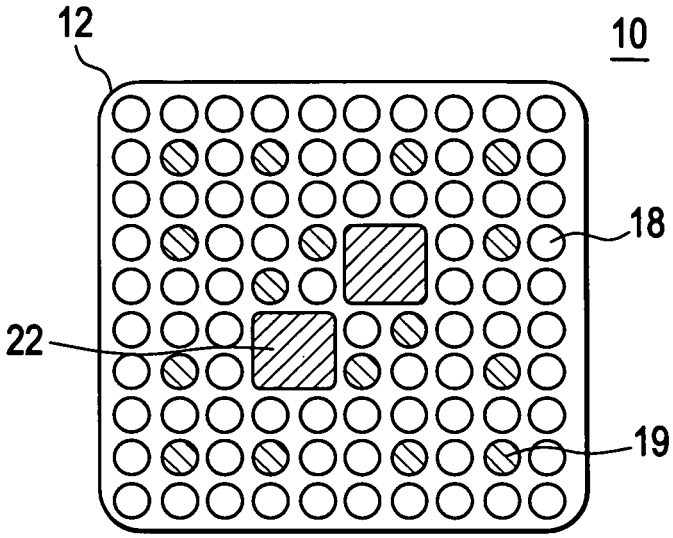
FIG. 2A RELATED ART
FIG. 2A is an illustration of a cross section of a related art fuel assembly showing rectangular water rods.
Figure 2B:
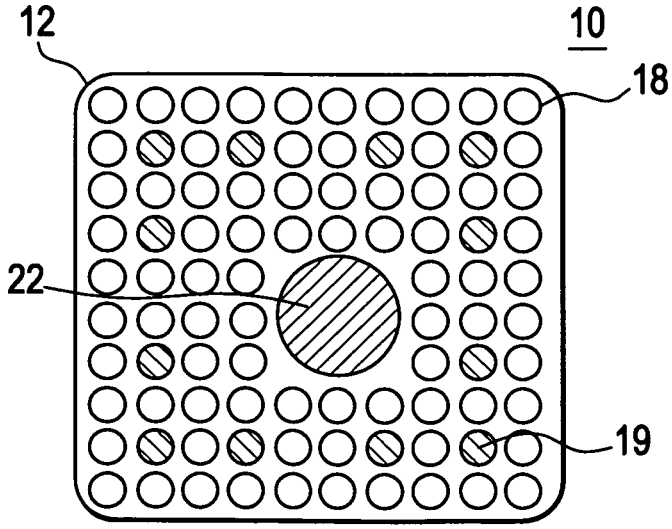
FIG. 2B RELATED ART
FIG. 2B is an illustration of a cross section of a related art fuel assembly showing a single, offset elliptical water rod.
Figure 2C:
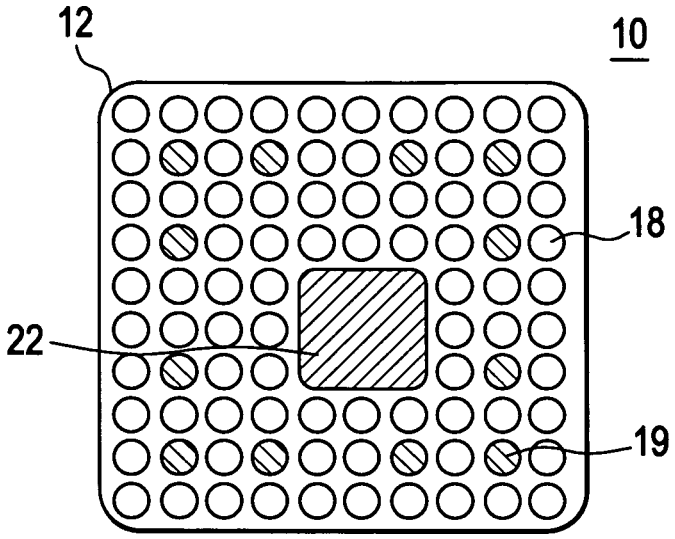
FIG. 2C RELATED ART
FIG. 2C is an illustration of a cross section of a related art fuel assembly showing a single, offset rectangular water rod.
Figure 2D:
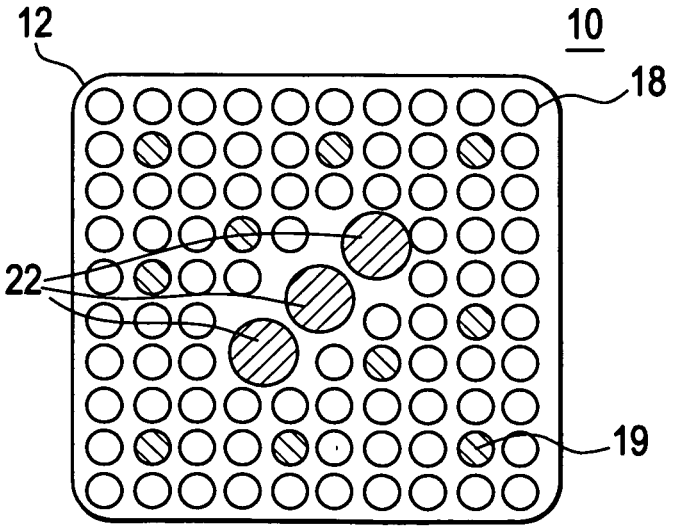
FIG. 2D RELATED ART
FIG. 2D is an illustration of a cross section of a related art fuel assembly showing multiple, circular water rods.

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

While example embodiments may be discussed in a particular setting or with reference to a particular field of technology, it is understood that example methods and embodiments may be employed and adapted outside of the disclosed contexts without undue experimentation or limiting the scope of the examples disclosed herein. For instance, although example embodiments may be shown in connection with a particular type of nuclear fuel assembly and water rod configuration, example embodiments may be adapted and/or applicable to any other fuel assembly and/or water rod configuration. Similarly, although example embodiments and methods are discussed with respect to conventional nuclear fuel assemblies, example embodiments and methods may also be applied in future fuel assembly designs.

The inventors have recognized that water rods in nuclear fuel assemblies provide an excellent source of fluid moderator to nuclear fuel assemblies and thereby also provide an excellent source of thermal neutrons within nuclear fuel assemblies. The inventors have recognized that the excellent source of thermal neutrons in water rods, instead of being used for continuing the nuclear chain reaction as in conventional fuel assemblies, may also be used to irradiate particular materials so as to produce desired isotopes and radioisotopes. These particular materials may be placed in water rods in nuclear fuel and then irradiated during operation of a reactor containing the nuclear fuel. The materials may be placed in positions and configurations so as to achieve desired assembly neutronic characteristics. The resulting isotopes and radioisotopes may then be harvested and used in industrial, medical, and/or any other desired applications. The inventors have created the following example methods and apparatuses in order to uniquely enable taking advantage of these newly-recognized benefits.

Example Methods

Figure 3:
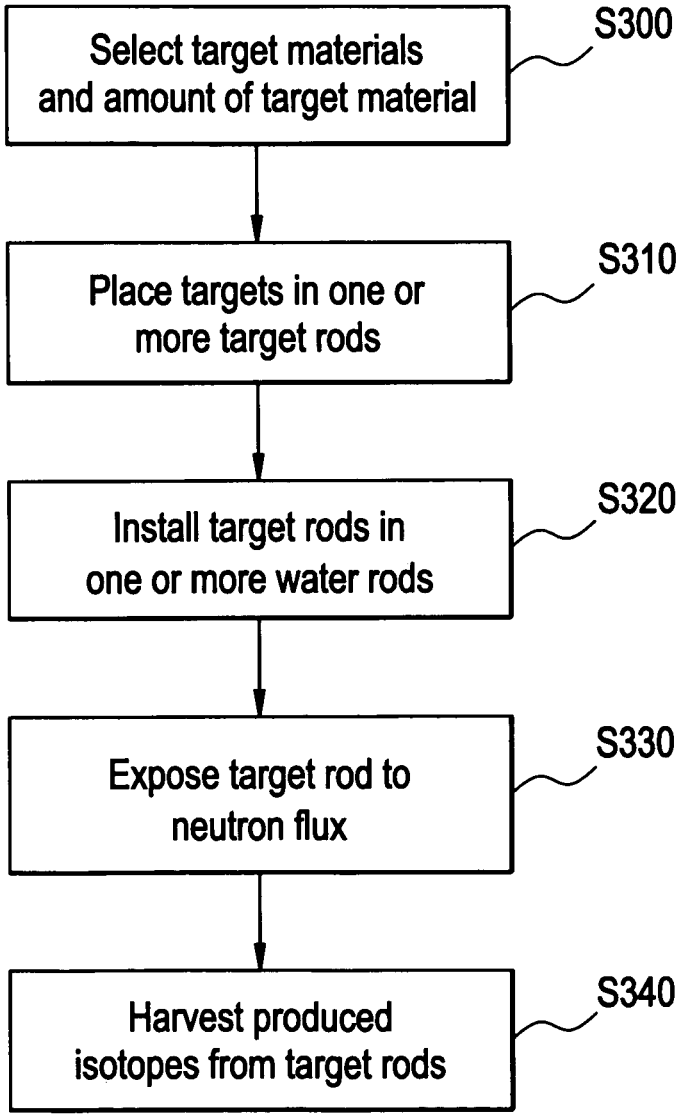
FIG. 3 is a flow chart of an example method for generating desired isotopes within water rods of nuclear fuel assemblies.

FIG. 3 is a flow chart illustrating example methods of using water rods to generate radioisotopes. As shown in FIG. 3, in S300, the user/engineer selects a desired material for use as an irradiation target. The engineer may select the target material and/or amount of target material based on type and half-life of isotopes that are produced from that material when exposed to a neutron flux. The engineer may further select the target material and/or amount of target material based on the knowledge of the length, amount, and type of a neutron flux that the target will be subjected to and/or absorb at its eventual position in an operating nuclear reactor. For example, cobalt-59, nickel-62, and/or iridium-191 may be selected in example methods because they readily convert to cobalt-60, nickel-63, and iridium-102, respectively, in the presence of a neutron flux. Each of these daughter isotopes have desirable characteristics, such as use as long-lived radioisotopes in the case of cobalt-60 and nickel-63, or use as a radiography source as in the case of iridium-102. The initial irradiation target amount may be chosen and/or example irradiation target products may have sufficiently long half-lives such that a useful amount of products remain undecayed at a time when the products are available for harvesting.

In S310, the selected targets may be placed and/or formed into a target rod. Example embodiment target rods are discussed and illustrated below. It is understood that several different types and phases of irradiation target materials may be placed into a target rod in S310 and that example embodiment target rods may be formed from irradiation targets. Alternatively, only a single type and/or phase of target material may be placed into a target rod in order to separate produced isotopes therein. In S320, target rods containing the selected irradiation target are installed in water rods of nuclear fuel assemblies. Example embodiment mechanisms for installing target rods in water rods are also discussed below with regard to example embodiments.

The engineer may further position and configure the target rods in S320 based on knowledge of operating conditions in a nuclear reactor and the fuel assembly into which the target rod will be installed. For example, the engineer may desire a larger water volume at higher axial positions within water rods and may accordingly place fewer target rods at higher axial positions within water rods and/or reduce the diameter of target rods at higher axial positions. Alternatively, for example, the engineer may calculate a desired level of neutron flux for a particular axial level within a fuel assembly and place target rods at the axial level to absorb excess flux and achieve the desired level of neutron flux absorption from the core. It is understood that the engineer may configure the target rods in shape, size, material, etc. and position the rods in S320 in order to achieve several desired assembly characteristics, including thermo-hydraulic and/or neutronic assembly characteristics. Similarly, such placement and configuration of target rods in S320 may meet other design goals, such as maximized isotope production, maximized water rod water volume, etc. It is understood that any determination of target rod configuration or placement and irradiation target selection based on fuel assembly parameters and desired characteristics may be made before executing example methods entirely, such that the desired configurations and placements in S320 are predetermined.

In S330, the target rods within water rods of nuclear fuel assemblies are exposed to neutron flux that converts the irradiation targets into desired daughter products. For example, the fuel assembly containing target rods may be loaded into a commercial nuclear reactor rated at 100 or more Megawatts-thermal and power operations may be initiated, thereby generating neutron flux in the assembly and water rods. The water rods, containing larger volumes of liquid moderator, may deliver larger amounts of thermal neutrons to target rods, enhancing desired isotope production from irradiation targets therein. Non-commercial reactors and testing settings may also be used to irradiate the irradiation targets within assembly water rods.

In S340, the produced isotopes may be harvested from the target rods. For example, the fuel assembly containing the target rods may be removed from the reactor during an operational outage, and the target rods may be removed from the assembly on-site or at off-site fuel handling facilities. The isotopes within the target rods may be removed from the target rods and processed or otherwise prepared for use. For example, irradiation targets and produced isotopes may be removed from a single target rod and chemically separated in hot-cell facilities, in order to purify the produced isotope.

Example methods being described, example embodiment target rods and other mechanisms for placing target rods in S310 and S320 are described below. It is understood that other example embodiments may be used with example methods described above in order to produce desired isotopes in water rods of nuclear fuel assemblies. Similarly, example embodiments described below may be used with other example methods using different steps and/or step ordering.

Example Embodiment Target Rods

Figure 4:
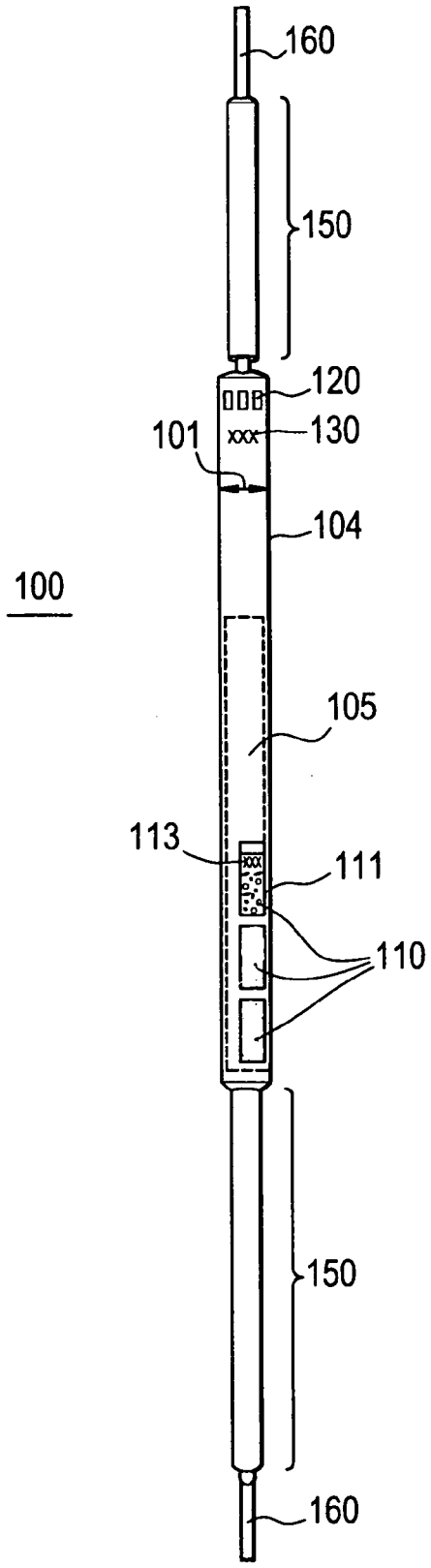
FIG. 4 is an illustration of an example embodiment target rod containing irradiation targets.

FIG. 4 illustrates an example embodiment target rod 100 useable in water rods of nuclear fuel assemblies to produce desired isotopes. As shown in FIG. 4, example target rods 100 may be generally elongated and cylindrical or otherwise shaped to fit within water rods 22 (FIGS. 1 & 2) in nuclear fuel assemblies. Example embodiment target rods 100 may have a cross section or diameter 101 that is smaller than a cross-section or diameter of water rods 22, in order to fit within the water rods. Diameter 101 may also be variable and/or substantially smaller than a diameter or cross-section of water rods in order to permit appreciable amounts of fluid coolant/moderator to pass through water rods while target rods 100 are installed in the water rods.

Example embodiment target rod 100 has an outer surface 104 that defines at least one internal cavity 105 where irradiation targets 110 may be contained. Cavity 105 is shaped and positioned within rod 100 so as to maintain irradiation targets 110 at desired axial heights or in other desired positions. As described in example methods above, irradiation targets 110 may be placed directly into cavity 105 of target rod 100, particularly if irradiation targets 110 and isotopes produced therefrom are solid materials. Similarly, liquid and/or gaseous irradiation targets 110 may be filled into cavity 105. Alternatively, additional containment structures 111 may be filled with desired irradiation targets 110, sealed, and placed within internal cavity 105. Containment structures 111 may provide an additional layer of containment between irradiation target 110 and the operating nuclear reactor and/or may serve to separate and contain different types/phases of irradiation targets and produced isotopes within cavity 105. For example, one or more different types of irradiation targets 110 may be placed in different containment structures 111 all placed into cavity 105. The different containment structures 111 may separate the different irradiation targets 110 and varying isotopes produced therefrom when exposed to neutron flux. Similarly, if a produced isotope is a liquid or gas, containment structures 111 may contain the produced liquid or gas in a smaller, defined region for easier handling and removal from cavity 105.

Containment structure 111 and/or irradiation targets 110 may bear indicia 113 identifying the target type and/or other characteristic. Similarly, example target rod 100 may include an external indicia 130 identifying the target or targets 110 contained therein or other desired information regarding target rod 100.

Example irradiation target rod 100 may further include an access point 120 that permits access to internal cavity 105 and irradiation targets 110 and isotopes produced from irradiation targets 110 in cavity 105. Access point 120 may be sealed so as to contain irradiation targets 110 and/or containment structures 111 while the target rod 100 is being exposed to neutron flux in an operating nuclear reactor. For example, access point 120 may be a mechanical seal or material bond sealing internal cavity 105 after irradiation targets 110 and/or containment structures 111 are placed therein. Access point 120 may include a series of hexes, flats, or other thinning mechanisms that permit controlled breaking and access to cavity 105 for harvesting produced isotopes therein. Alternatively, access point 120 may include a threaded end and complementary threaded inner surface that permit screwing and unscrewing parts of rod 100 in order to seal and access cavity 105 repeatedly. Other known joining and disjoining mechanisms may be present at access point 120, permitting access to and sealing of internal cavity 105.

Example embodiment target rod 100 may include one or more fastening devices 160 that permit joining or otherwise securing example target rod 100 within a water rod in an operating nuclear reactor. For example, fastening device 160 may be a fastener that latches on to an exterior of water rods 22 (FIG. 1) or may be a welding connection point to water rods 22 (FIG. 1). Alternatively, fastening device 160 may interact with example embodiment securing mechanisms discussed below.

Example embodiment target rod 100 may take on any desired shape or configuration to meet desired fuel assembly parameters and/or neutron flux exposure. For example, example target rod 100 may be a length that permits or prevents target rod 100 and/or irradiation targets 110 therein extending to axial positions within a water rod where target rod 100 presence is desired or undesired. For example, the engineer may identify a particular axial position within the nuclear fuel assembly with ideal neutron flux levels for producing isotopes from an amount of material in an irradiation target 110 and may create target rod 100 and internal cavity 105 such that the irradiation target 110 is positioned at the axial position when installed in the water rod. Or, for example, target rod 100 may further include tapered ends 150 that reduce target rod 100 cross section and permit larger water volume in water rods where target rod 100 is placed, so as to permit larger amounts of moderation and/or heat transfer to the water.

Example embodiment target rod 100 may be fabricated of any material that will substantially maintain its mechanical and neutronic properties in an operating nuclear reactor environment while providing adequate containment to irradiation targets 110 housed therein. For example, target rod 100 may be fabricated from zirconium and alloys thereof, corrosion-resistant stainless steel, aluminum, etc., based on the material needs of target rod 100 and/or materials used to fabricate water rods 22 (FIG. 1).

In an alternative embodiment, example target rods may be fabricated from the irradiation target material itself, if the irradiation target and produced isotopes therefrom have appropriate physical characteristics. For example, example target rods 100 may be fabricated of iridium-191 and placed within water rods in accordance with example methods, because iridium-191 and its generated isotope—iridium-192—are solid and compatible with operating nuclear reactor conditions. In such an embodiment, target rods may or my not possess internal cavities that house yet further irradiation targets.

It is understood that example embodiment target rods may be varied in several ways from the descriptions given above and still perform the functions of containing the irradiation targets within water rods of nuclear fuel assemblies. Further, example embodiment target rods may be affixed to or otherwise held in water rods alone or in combination with the example embodiment loading and securing mechanisms discussed below.

Example Embodiment Securing Mechanisms

Figure 5:
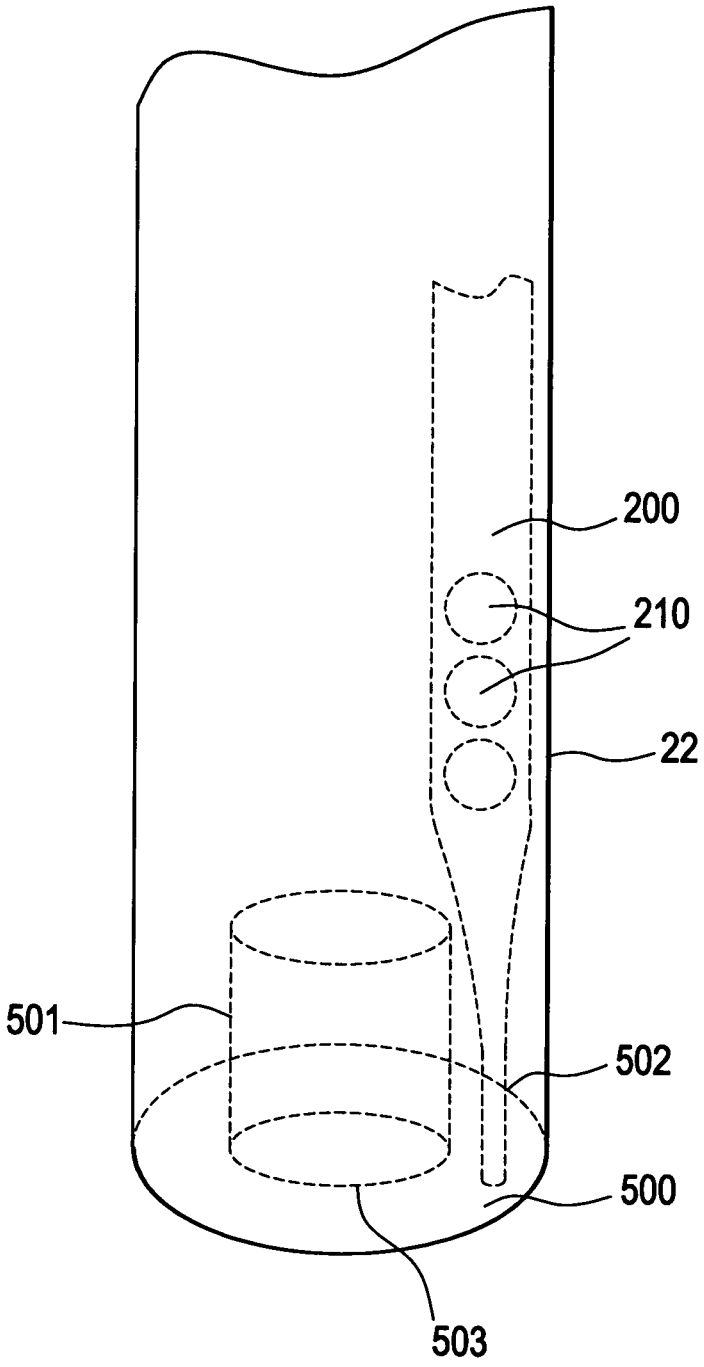
FIG. 5 is an illustration of an example embodiment collar and bushing for securing irradiation targets within water rods.

Several different example securing mechanisms may be used to hold one or more example embodiment target rods within water rods of nuclear fuel assemblies. FIG. 5 is an illustration of an example embodiment water rod ledge collar 500. Example embodiment collar 500 may be affixed to a conventional water rod 22 at its lower terminus 502 in a fuel assembly. Collar 500 may radially extend into the channel of water rod 22 and provide a ledge on which example embodiment target rods 200 may rest in water rod 22. Example embodiment target rods 200 may be similar to example target rods discussed above and may be miniaturized or otherwise altered in size to fit on collar 500 and/or to permit appropriate spacing within water rod 22. Similarly, one or more irradiation targets 210 may be placed in and/or strung together within a target rod 200. Collar 500 retains a flow passage 503 through which liquid coolant/moderator may flow into and through water rod 22.

Target rods 200 may rest upon or be fastened, welded, threaded and/or otherwise secured to collar 500 in order to retain target rods in a constant position within water rod 22. Additionally, a bushing 501 may be joined to collar 500 and extend axially upward into water rod 22. Bushing 501 may additionally secure example embodiment target rods 200 to a circumferential position within water rod 22. Bushing 501 may be fastened, welded, or continuous with collar 500 and retain flow passage 503 into water rod 22. Both collar 500 and bushing 501 may be fabricated from materials retaining their mechanical and neutronic properties when exposed to operating conditions in a nuclear reactor, including example materials such as stainless steel and/or zirconium alloys.

Collar 500 and bushing 501 may be a variety of shapes, depending on the shape of water rod 22. For example, if water rod 22 were peanut-shaped, collar 500 and/or bushing 501 may additionally be peanut-shaped. Similarly, collar 500 and bushing 501 do not necessarily extend around the entire inner perimeter of water rods 22; collar 500 and/or bushing 501 may be present at only a portion of the inner perimeter of water rods 22. Although collar 500 and bushing 501 are shown at a lower terminus 502 of water rod 22, it is understood that collar 500 and/or bushing 501 may be moved to other axial positions in water rod 22, in order to achieve a desired positioning of example embodiment target rods 200 supported thereby.

It is understood that example embodiment collar 500, with or without bushing 501, may be used in conjunction with other retaining devices for example target rods. For example, rod 200 may be further fastened to water rod 22 through fastening device 160 (FIG. 4) in addition to being supported by collar 500 and bushing 501.

Figure 6A:
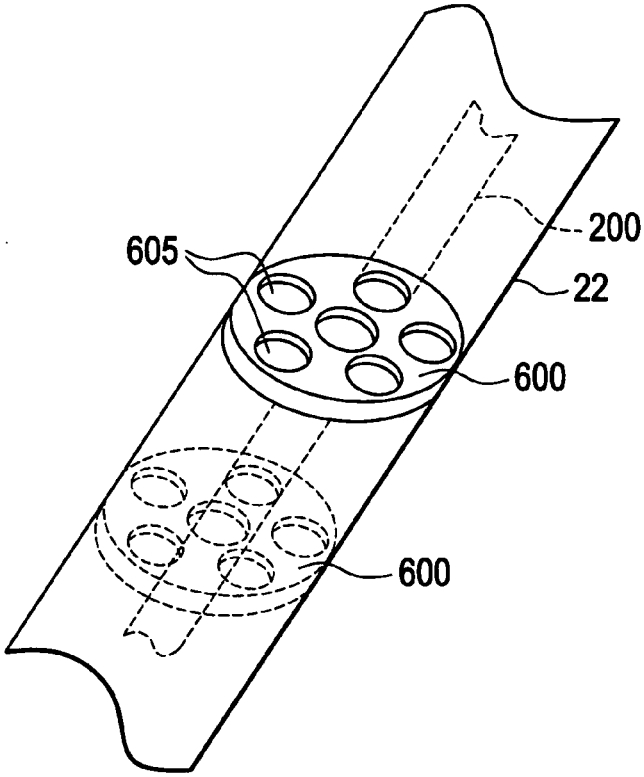
FIGS. 6A and 6B are illustrations of an example embodiment modular washer for securing irradiation targets within water rods.
Figure 6B:
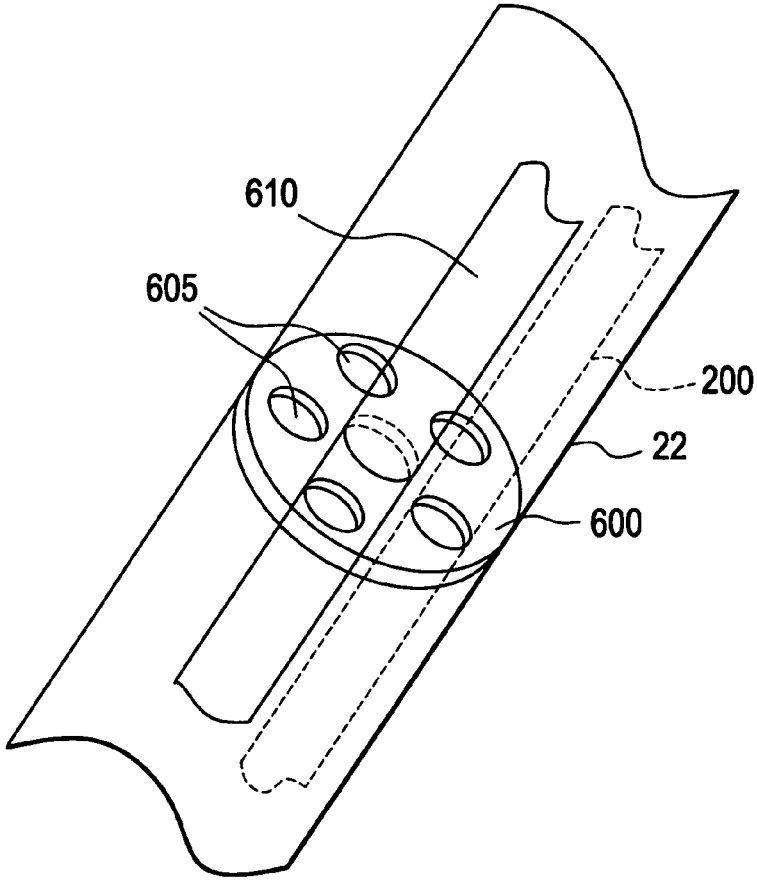

FIGS. 6A and 6B are illustrations of an example embodiment modular washer 600 that may be used to secure and retain example target rods 200 within water rods 22. As shown in FIG. 6A, one or more example embodiment washer 600 may be placed within water rod 22 at one or more axial positions. Example washer 600 may be held at a particular axial position by friction alone and/or through fastening or joining mechanisms such as welding and/or an indentation in water rod 22 that holds washer 600 stationary. Alternatively, as shown in FIG. 6B, a central post or tube 610 may extend through an aperture 605 and be affixed to several washers 600. The washers may thus be held at constant relative distances and rotations by central tube 610, while central tube 610 still permits fluid moderator/coolant to flow through central tube 610 and water rod 22.

Example embodiment modular washer 600 includes one or more apertures 605 at desired locations in washer 600. Apertures 605 are shaped to permit at least one target rod 200 pass through and/or join washer 600. Target rods 200 may frictionally seat within apertures 605 and/or may be otherwise held or loosely fit within apertures 605. In this way, apertures 605 hold target rod 200 in a fixed angular and/or axial position within washer 600 and thus in water rod 22. Apertures 605 holding target rods 100 may prevent or reduce movement of target rods 100 during operation of the nuclear reactor. Washer 600 may further include several unfilled apertures 605 that permit coolant/moderator flow through water rod 22. Several apertures 605 may hold target rods 200, such that multiple target rods 200, may be held in constant positions relative to each other within water rod 22 by example embodiment washers 600.

Multiple washers 600 may be used in a single water rod 22. As shown in FIG. 6A, other washers may hold to a same and/or different target rods 200 within water rod 22. The additional example embodiment washers may provide additional stability and alignment for target rods 200 passing through multiple washers 600.

Example embodiment washers 600 may be fabricated from materials retaining their mechanical and neutronic properties when exposed to operating conditions in a nuclear reactor, including example materials such as stainless steel and/or zirconium alloys. Washers 600 may be a variety of shapes, depending on the shape of water rod 22. For example, if water rod 22 were triangular, washers 600 may be similarly triangular. Example embodiment washer 600 does not necessarily extend around the entire inner perimeter of water rods 22; washer 600 may be present at only a portion of the inner perimeter of water rods 22. It is understood that washer 600 may be moved to other axial positions in water rod 22, in order to achieve a desired positioning of example embodiment target rods 200 supported thereby.

It is understood that example embodiment washers 600 may be used alone or in conjunction with other retaining devices for example target rods. For example, target rod 200 may be further fastened to water rod 22 through fastening device 160 (FIG. 4) or supported by collar 500 and bushing 501 (FIG. 5) in addition to being secured by washers 600. Example embodiment fuel assemblies may include all or some of the above-described example embodiment target rods and retaining structures useable in accordance with example methods.

Example embodiment retaining structures including example embodiment washers 600 and/or ledge collar 500 may be installed during manufacture of fuel assemblies that will contain the same. Example embodiment retaining structures may also be installed after a fuel assembly is completed, or in existing fuel assemblies. As described above with regard to example methods, example embodiment retaining structures may be installed at desired positions/configurations to meet specific assembly criteria. Example embodiment target rods may be installed with retaining structures or after their installation, as described in S320 above.

Because example embodiments and methods permit and enable irradiation targets to be subjected to plentiful thermal flux levels present in nuclear reactor water rods, isotope products created in example embodiments and methods may possess higher activity and/or purity and may be generated in smaller amounts of time. Example embodiments and methods further provide nuclear engineers with additional tools for configuring fuel assembly neutronic and/or thermodynamic properties by placing irradiation targets within water rods where they may favorably affect these properties while generating desired isotopes.

Example embodiments thus being described, it will be appreciated by one skilled in the art that example embodiments may be varied through routine experimentation and without further inventive activity. For example, although example embodiments and methods are given with respect to existing fuel assembly designs and water rod configurations, it is certainly within the skill of the nuclear engineer to revise example embodiments and methods to suit future designs while maintaining the above-described properties of example embodiments and methods. Variations are not to be regarded as departure from the spirit and scope of the exemplary embodiments, and all such modifications as would be obvious to one skilled in the art are intended to be included within the scope of the following claims.

What is claimed is:

1. A method of generating isotope products, the method comprising:

selecting an irradiation target;

placing the irradiation target in a target rod;

installing the target rod in a water rod of a nuclear fuel assembly such that the irradiation target is surrounded by a fluid in the water rod;

holding the target rod within the water rod with at least one securing device; and exposing the irradiation target to a neutron flux so as to substantially convert the irradiation target into isotope products, wherein the at least one securing device includes a washer affixed to the water rod at an axial position, the washer including a plurality of apertures, the target rod extending through one of the plurality of apertures.

2. The method of claim 1, wherein the placing the irradiation target includes forming the irradiation target into the target rod.

3. The method of claim 1, further comprising:

harvesting the isotope products from the water rod.

4. The method of claim 1, wherein the placing the irradiation target includes positioning the irradiation target at a position within the water rod to achieve a desired neutronic or thermodynamic property of the nuclear fuel assembly.

5. The method of claim 1, wherein the selecting the irradiation target includes selecting a type and amount of irradiation target to achieve a desired activity of isotope product based on the properties of the irradiation target and amount and duration of the neutron flux to which the irradiation target is exposed.

6. The method of claim 1, wherein the exposing the irradiation target to neutron flux includes commencing power operation in a 100+ $MW_{th}$ reactor containing the fuel assembly.

7. A method of generating isotope products, the method comprising:

placing an irradiation target in a target rod, installing the target rod in a water rod of a nuclear fuel assembly;

holding the target rod within the water rod with at least one securing device such that the target rod is surrounded by a fluid in the water rod, the target rod installed at a position within the water rod to achieve a desired neutronic or thermodynamic property of the nuclear fuel assembly and a desired activity of isotope product, the installing based on the properties of the irradiation target and amount and duration of neutron flux to which the irradiation target will be exposed at the position; and exposing the irradiation target to the neutron flux at the position for the duration so as to convert the irradiation target into isotope products, wherein the at least one securing device includes a washer affixed to the water rod at an axial position, the washer including a plurality of apertures, the target rod extending through one of the plurality of apertures.

8. The method of claim 7, wherein the exposing the irradiation target to the neutron flux includes commencing power operation in a 100+ $MW_{th}$ reactor containing the fuel assembly.

9. The method of claim 7, wherein a plurality of irradiation targets are placed in the target rod, the plurality of irradiation targets not being fabricated of a same material.

10. A system for producing isotopes in a water rod of a fuel assembly, the system comprising:

at least one target rod containing an irradiation target, the at least one target rod having a size that permits placement of the at least one target rod within the water rod, the at least one target rod having a configuration that permits the at least one target rod to be surrounded by a fluid in the water rod; and at least one securing device configured to hold the at least one target rod within the water rod during operation of a reactor containing the fuel assembly, wherein the at least one securing device includes a collar joined to the water rod at an axial position and extending radially into the water rod, the collar supporting the at least one target rod at the axial position.

11. The system of claim 10, wherein the collar and at least one target rod supported by the collar are joined.

12. The system of claim 10, wherein the at least one securing device further includes a bushing extending axially upward from the collar and joined to the collar, the bushing limiting radial movement of the at least one target rod within the water rod.

13. The system of claim 10, wherein the at least one securing device includes a washer affixed to the water rod at an axial position, the washer including a plurality of apertures, the at least one target rod extending through one of the plurality of apertures.

14. The system of claim 13, wherein the one of the plurality of apertures has a diameter substantially equal to that of the target rod extending therethrough, so as to frictionally join with and maintain the position of the target rod extending therethrough.

15. The system of claim 10, wherein the target rod has an outer wall that defines a cavity inside the target rod.

16. The system of claim 15, wherein one or more irradiation targets are positioned within the cavity.

17. The system of claim 10, wherein the target rod further includes a joining device configured to join to the water rod and hold the target rod stationary therein.

18. A nuclear fuel assembly, comprising:

a plurality of fuel rods containing fissile material, the fuel rods extending in an axial direction;

at least one water rod extending in the axial direction, the water rod being open-ended at ends of the fuel assembly so as to permit fluid to flow through the fuel assembly in the axial direction;

at least one irradiation target positioned within the at least one water rod such that the at least one irradiation target is surrounded by the fluid in the water rod, the irradiation target substantially converting into an isotope product when exposed to neutron flux in the water rod;

at least one target rod containing the irradiation target, the at least one target rod having a size that permits placement of the at least one target rod within the water rod; and at least one securing device configured to hold the at least one target rod within the water rod during operation of a reactor containing the fuel assembly, wherein the at least one securing device includes a collar joined to the water rod at an axial position and extending radially into the water rod, the collar supporting the at least one target rod at the axial position.

19. The fuel assembly of claim 18, wherein the at least one securing device further includes a bushing extending axially upward from the collar and joined to the collar, the bushing limiting radial movement of the at least one target rod within the water rod.

20. The fuel assembly of claim 18, wherein the at least one securing device includes a washer affixed to the water rod at an axial position, the washer including a plurality of apertures, the at least one target rod extending through one of the plurality of apertures.

* * * * *